US006843090B2

(12) United States Patent
Sato et al.

(10) Patent No.: US 6,843,090 B2
(45) Date of Patent: Jan. 18, 2005

(54) ROLLING DEVICE FOR RING

(75) Inventors: Hideshi Sato, Sayama (JP); Katsuyuki Nakajima, Sayama (JP); Yoriyuki Watanabe, Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 35 days.

(21) Appl. No.: 10/399,537

(22) PCT Filed: Oct. 3, 2001

(86) PCT No.: PCT/JP01/08706

§ 371 (c)(1),
(2), (4) Date: Apr. 18, 2003

(87) PCT Pub. No.: WO02/36285

PCT Pub. Date: May 10, 2002

(65) Prior Publication Data

US 2004/0035170 A1 Feb. 26, 2004

(30) Foreign Application Priority Data

Oct. 20, 2000 (JP) ..... 2000-321612
Oct. 20, 2000 (JP) ..... 2000-321613

(51) Int. Cl.[7] ..... B21D 15/00

(52) U.S. Cl. ..... 72/110; 72/111; 72/13.4; 72/13.5

(58) Field of Search ..... 72/10.1, 10.3, 72/10.4, 13.4, 13.5, 14.2, 14.4, 107, 108, 110, 111, 168, 183, 205, 378

(56) References Cited

U.S. PATENT DOCUMENTS 4,176,538 A * 12/1979 Kymmell et al. ..... 72/110
4,757,701 A * 7/1988 Hamada ..... 72/110
5,640,868 A 6/1997 Lauener
6,318,140 B1 * 11/2001 Yamagishi et al. ..... 72/110

FOREIGN PATENT DOCUMENTS

JP 61-63307 * 4/1986 ..... B21B/5/00
JP 5-80295 B 11/1993
JP 11-290908 A 10/1999
SU 1237398 * 6/1986 ..... 72/110

* cited by examiner

*Primary Examiner*—Ed Tolan
(74) *Attorney, Agent, or Firm*—Birch, Stewart, Kolasch & Birch, LLP

(57) ABSTRACT

A rolling apparatus is capable of rolling a metal ring to an accurate circumferential length and preventing the metal ring from dropping off. The rolling apparatus includes a metal ring support assembly having tension rollers 2*a*, 2*b* for supporting a metal ring W, a rolling roller 5 for rolling the metal ring W, a rolling assembly for pressing the rolling roller 5 against the metal ring W, a tension applying assembly having a tension cylinder 23 engaging tension roller support members 8, 10, 25, on which one of the tension rollers 2*b* is rotatably supported, for displacing the tension roller 2*b* to apply tension to the metal ring W, and a rolling processing completing assembly 27 for detecting a completion of rolling of the metal ring W and inactivating the rolling assembly and the tension applying assembly. The rolling assembly has a first resilient member 18 interposed between the rolling cylinder 14 and its piston rod 15. The tension applying assembly has a second resilient member 28 interposed between a piston rod 24 of the tension cylinder 23 and the tension roller support member 25.

5 Claims, 3 Drawing Sheets

ROLLING DEVICE FOR RING

This application is the national phase under 35 U.S.C. §371 of PCT International Application No. PCT/JP01/08706 which has an International filing date of Oct. 3, 2001, which designated the United States of America.

This application is the national phase under 35 U.S.C. §371 of PCT International Application No. PCT/JP01/08706 which has an International filing date of Oct. 3, 2001, which designated the United States of America.

TECHNICAL FIELD

The present invention relates to an apparatus for rolling a metal ring for use in a belt for a continuously variable transmission.

BACKGROUND ART

Laminated rings for use in belts for continuously variable transmissions are manufactured by laminating a plurality of ring-shaped members having slightly different circumferential lengths. The ring-shaped members are prepared by welding opposite ends of a thin sheet of maraging steel, which is an ultrahigh strength steel, into a cylindrical drum, and slicing the cylindrical drum into thin-sheet metal rings. The thin-sheet metal rings are then rolled into ring-shaped members having respective desired circumferential lengths.

One known apparatus for rolling such metal rings is disclosed in Japanese laid-open patent publication No. 11-290908. The disclosed apparatus has a pair of tension rollers spaced horizontally a given distance from each other for supporting a thin-sheet metal ring thereon. The rolling apparatus also has a guide roller disposed intermediate between the tension rollers and a rolling roller for gripping and rolling the metal ring in coaction with the guide roller.

The rolling roller is pressed against the metal ring by a rolling cylinder. At least one of the tension rollers is displaceable away from the other tension roller by a tension cylinder.

The rolling apparatus operates as follows: The metal ring is trained around the tension rollers. The rolling cylinder is actuated to press the rolling roller against the metal ring, which is gripped between the rolling roller and the guide roller. The rolling roller is rotated to roll the metal ring to progressively increase the circumferential length of the metal ring. When the metal ring is rolled, the tension cylinder displaces at least one of the tension rollers away from the other tension roller by a distance corresponding to the increase in the circumferential length of the metal ring, thus tensioning the metal ring. The displacement of the tension roller prevents the metal ring from dropping off the tension rollers.

Then, the rolling apparatus measures the circumferential length of the metal ring which is progressively increased when the metal ring is rolled. When the circumferential length of the metal ring has reached a desired value, the rolling process is finished. The circumferential length of the metal ring can be determined as a function of the distance between the axes of the tension rollers. The rolling apparatus uses an encoder, for example, for measuring the distance by which the tension roller is displaced by the tension cylinder. The encoder detects a completion of the rolling process when the distance by which the tension roller is displaced reaches a given value. Then, the encoder outputs an electric signal to stop the tension cylinder and the rolling cylinder. After the rolling cylinder is thus stopped, it releases the rolling roller from pressing the metal ring.

The rolling cylinder takes a time ranging from 0.01 to 0.1 second in releasing the rolling roller from pressing the metal ring because of a mechanical device used to release the rolling roller. During such a time, the rolling roller remains pressed against the metal ring, and continuously rotates due to the inertia from the rolling process. As a result, the metal ring is excessively rolled after the rolling process is completed.

The tension cylinder and the rolling cylinder are separate mechanical arrangements which cause them to stop at different times, which are 0.01 to 0.1 second apart from each other, in response to the electric signal from the encoder. If the stoppage of the rolling cylinder is delayed due to the stop timing difference, then the metal ring may further be excessively rolled. Even if the rolling cylinder is stopped prior to the tension cylinder, the metal ring may further be excessively rolled because of continued rotation due to the inertia.

When the metal ring is excessively rolled after the rolling process is completed, the tension ring has already been stopped. Therefore, no tension is imparted to the metal ring which is excessively rolled. As a consequence, the metal ring may possibly fall off the tension rollers.

DISCLOSURE OF THE INVENTION

It is therefore an object of the present invention to provide a rolling apparatus which is capable of rolling a metal ring accurately to a predetermined circumferential length by eliminating drawbacks caused by different times at which a tension cylinder and a rolling cylinder are stopped.

Another object of the present invention is to provide a rolling apparatus which is capable of reliably preventing a metal ring from dropping off after the metal ring has been rolled.

To achieve the above objects, there is provided in accordance with the present invention an apparatus for rolling a metal ring, comprising metal ring supporting means having a pair of tension rollers for supporting a thin-sheet metal ring thereon and a tension roller support member on which at least one of said tension rollers is rotatably supported, rolling means having a guide roller disposed intermediate between said tension rollers, a rolling roller for gripping and rolling the metal ring between the rolling roller and said guide roller, a rolling roller support member on which said rolling roller is rotatably supported, and a rolling cylinder having a piston rod connected to said rolling roller support member for pressing said rolling roller against said metal ring through said rolling roller support member, tension applying means having a tension cylinder having a piston rod engaging said tension roller support member for applying tension to said metal ring by displacing said least one of said tension rollers through said tension roller support member to displace said tension rollers relatively from each other when said metal ring is rolled by said rolling means, and rolling process completing means for detecting a completion of rolling of said metal ring by measuring an amount of relative displacement of said tension rollers, and inactivating said rolling means and said tension applying means, said rolling means having a first resilient member interposed between said rolling cylinder and said piston rod thereof, for moving said piston rod in a direction to release said rolling roller from pressing said metal ring when said rolling process completing means detects a completion of rolling of said metal ring and inactivates said rolling means.

With the above arrangement, the first resilient member is interposed between said rolling cylinder and said piston rod thereof. For rolling the metal ring, the rolling cylinder moves the piston rod against the bias of the first resilient member, thereby pressing the rolling roller against the metal ring.

When the rolling process completing means detects a completion of rolling of said metal ring and inactivates said rolling means, the first resilient member returns immediately to its original state. The biasing force of the first resilient member acts between the rolling cylinder and the piston rod. The piston rod is moved in a direction to release the rolling roller from pressing the metal ring. As a result, the rolling cylinder releases the rolling roller from pressing the metal ring without waiting for the mechanical arrangement thereof to move the piston rod.

Therefore, after the rolling process completing means detects a completion of rolling of said metal ring, the metal ring is prevented from being excessively rolled and has an accurate desired circumferential length.

The tension applying means comprises a second resilient member interposed between said tension roller support member and the piston rod of said tension cylinder, for causing said tension roller support member to displace said least one of said tension rollers away from the other tension roller to apply tension to said metal ring when said rolling process completing means detects a completion of rolling of said metal ring and inactivates said tension cylinder.

With the above arrangement, the second resilient member interposed between said tension roller support member and the piston rod of said tension cylinder. For rolling the metal ring, the tension cylinder moves the piston rod to move the tension roller support member against the bias of the second resilient member. As a result, the tension roller is displaced in a direction away from the other tension roller. Consequently, the tension commensurate with the amount of rolling of the metal ring is applied to the metal ring.

When the rolling process completing means detects a completion of rolling of said metal ring and inactivates said tension cylinder, the second resilient member returns immediately to its original state. The biasing force of the second resilient member acts between the piston rod and the tension roller support member. The tension roller is urged in a direction away from the guide roller through the tension roller support member. As a result, even when the metal ring is excessively rolled by the rolling means after the rolling process completing means detects a completion of rolling of said metal ring, a displacement commensurate with the elongation, or the increase in the circumferential length, of the metal ring due to the excessive rolling is imparted to the tension roller support member. The metal ring is kept under tension and reliably prevented from dropping off the tension rollers.

Both of the first and second resilient members may comprise a spring or a rubber member. The rubber member may be made or natural rubber or synthetic rubber such as urethane resin or the like.

The rolling process completing means may comprise an arm extending from said tension roller support member parallel to the piston rod of said tension cylinder, a rotor rotatable in rolling contact with said arm, and a detector for detecting an amount of angular displacement of said rotor, and converting the amount of angular displacement of said rotor into an amount of displacement of said arm to detect an amount of displacement of said tension roller.

The above and other objects, features, and advantages of the present invention will become apparent from the following description when taken in conjunction with the accompanying drawings which illustrate a preferred embodiment of the present invention by way of example.

BEST MODE FOR CARRYING OUT THE INVENTION

Figure 1:
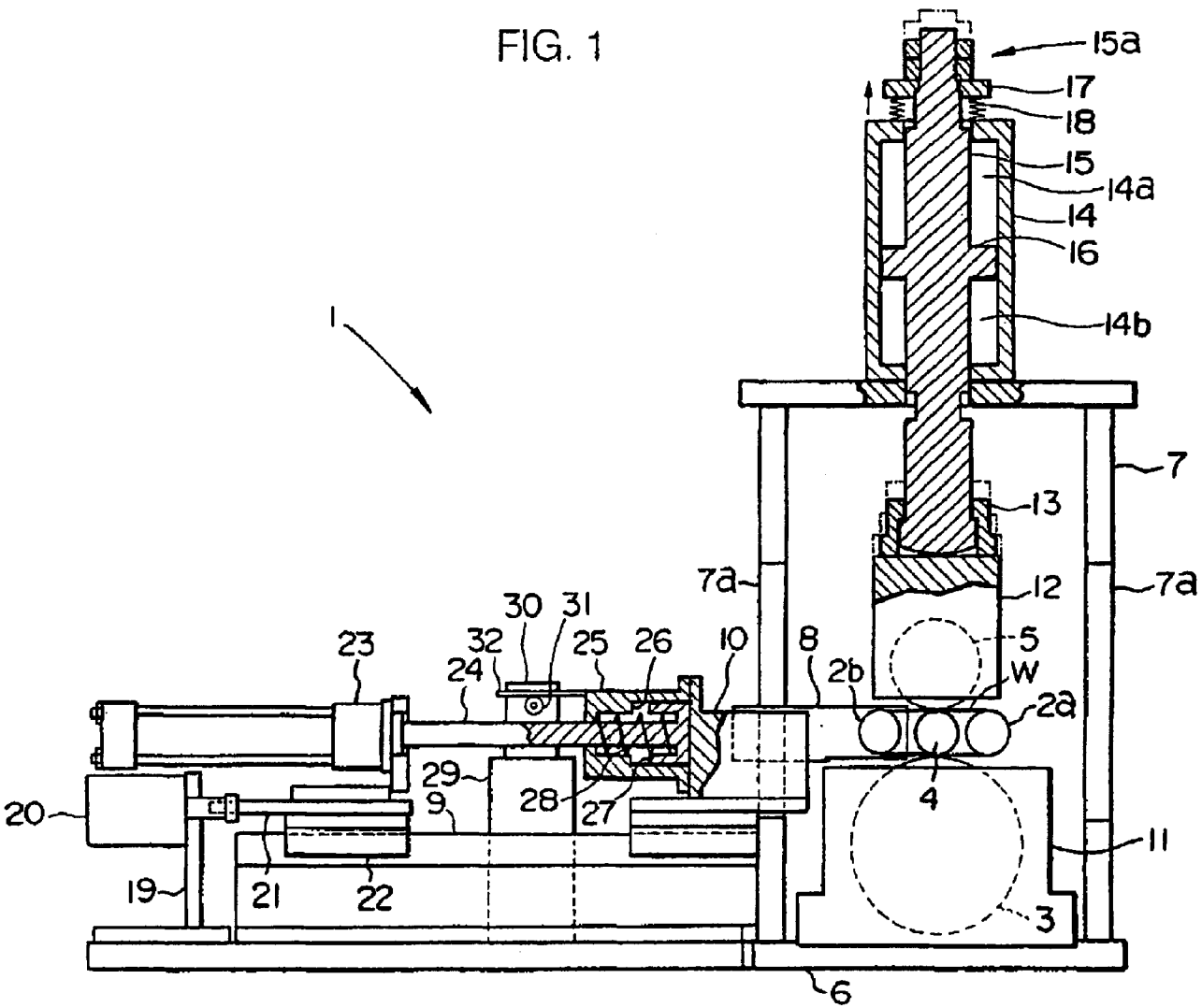
FIG. 1 is a front elevational view, partly in cross section, of a rolling apparatus according to the present invention.

As shown in FIG. 1, a rolling apparatus 1 according to the present invention has a pair of tension rollers 2*a*, 2*b* spaced horizontally a given distance from each other for supporting a thin-sheet metal ring W thereon. The rolling apparatus 1 also has a backup roller 3, a guide roller 4, and a rolling roller 5 which are vertically arrayed intermediate between the tension rollers 2*a*, 2*b*. The rolling apparatus 1 has a casing 7 mounted on a base 6 and having an open front side for attachment and removal of the metal ring W. The casing 7 has recesses 7*a* defined in its side walls laterally of the rollers 2*a*, 2*b*, 4, 5.

The tension roller 2*a* has a rear end rotatably supported on the casing 7. The tension roller 2*a* has a rear end rotatably supported on a support member 8 which extends horizontally through one of the recesses 7*a*. The support member 8 is mounted on a slide member 10 that is slidably mounted on a rail 9 disposed on the base 6 laterally of the casing 7. When the slide member 10 slides on the rail 9, the support member 8 displaces the tension roller 2*b* away from the tension roller 2*a*. A mechanism for displacing the tension roller 2*b* will be described in detail later on.

The backup roller 3 is rotatably supported on a base unit 11 mounted on the base 6 in the casing 7, and is disposed below an intermediate position between the tension rollers 2*a*, 2*b*. The guide roller 4 has a rear end rotatably supported on the casing 7, and is positioned intermediate between the tension rollers 2*a*, 2*b*. The guide roller 4 grips the metal ring W trained around the tension rollers 2*a*, 2*b* between itself and the backup roller 3 and the rolling roller 5.

The rolling roller 5 is rotatably supported on a support member 12 and disposed above the guide roller 3. The support member 12 is connected by a flange 13 to a piston rod 15 of a rolling cylinder 14 mounted on an upper wall of the casing 7. The piston rod 15 extends vertically through the rolling cylinder 14, and has a piston 16 slidable along an inner wall surface of the rolling cylinder 14. The piston rod 15 has an end 15*a* projecting upwardly from the upper end of the cylinder 14, and an engagement member 17 is threaded over the projecting end 15*a* of the piston rod 15. A spring 18 as a first resilient member is disposed between the upper end of the cylinder 14 and the engagement member 17.

The interior of the rolling cylinder 14 is divided into an upper chamber 14*a* and a lower chamber 14*b* by the piston 16. When an oil pressure from an oil pressure unit (not shown) is supplied into the upper chamber 14*a*, the piston 16 lowers the piston rod 15. When the oil pressure is supplied into the lower chamber 14*b*, the piston 16 elevates the piston rod 15.

When the piston 16 lowers the piston rod 15, the rolling roller 5 is pressed against the metal ring W and grips the metal ring W trained around the tension rollers 2*a*, 2*b* between the rolling roller 5 and the guide roller 4 supported by the backup roller 3. A motor (not shown) is disposed behind the rear end of the rolling roller 5. The rolling roller 5 is connected to the rotatable shaft of the motor through a universal joint. When the motor is energized, therefore, the rolling roller 5 is rotated about its own axis. When rotated, the rolling roller 5 rolls the metal ring W that is gripped between the rolling roller 5 and the guide roller 4.

The mechanism for displacing the tension roller 2*b* will be described below.

A support column 19 is vertically mounted on the base 6 laterally of the rail 9. The support column 19 supports thereon a first tension cylinder 20 having a piston rod 21 extending therefrom which is connected to a slide member 22 that is slidably mounted on the rail 9. Therefore, the slide member 22 is slidable back and forth along the rail 9 by the piston rod 21.

A second tension cylinder 23 is mounted on the slide member 22 and has a piston rod 24 extending therefrom which is connected to the slide member 10 on the rail 9 through a tubular member 25. The slide member 10 is slidable back and forth along the rail 9 by the piston rod 24 of the second tension cylinder 23.

The slide member 10 supports thereon the support member 8 on which the tension roller 2*b* is rotatably supported, as described above. The support member 8 and the tension roller 2*b* are movable back and forth in unison with the slide member 10.

The tubular member 25 attached to the slide member 10 is of a hollow cylindrical shape and houses therein a distal end of the piston rod 24 which extends through a closed end of the second tension cylinder 23. The tubular member 25 has a step 26 therein where the inner wall of the tubular member 25 closer to the second tension cylinder 23 is smaller in diameter than the inner wall of the tubular member 25 closer to the slide member 10. The step 26 is engageable with an engagement member 27 of channel-shaped cross section on the distal end of the piston rod 24. A spring 28 as a second resilient member is disposed around the piston rod 24 axially between the closed end of the tubular member 25 closer to the second tension cylinder 23 and the engagement member 27.

Figure 2:
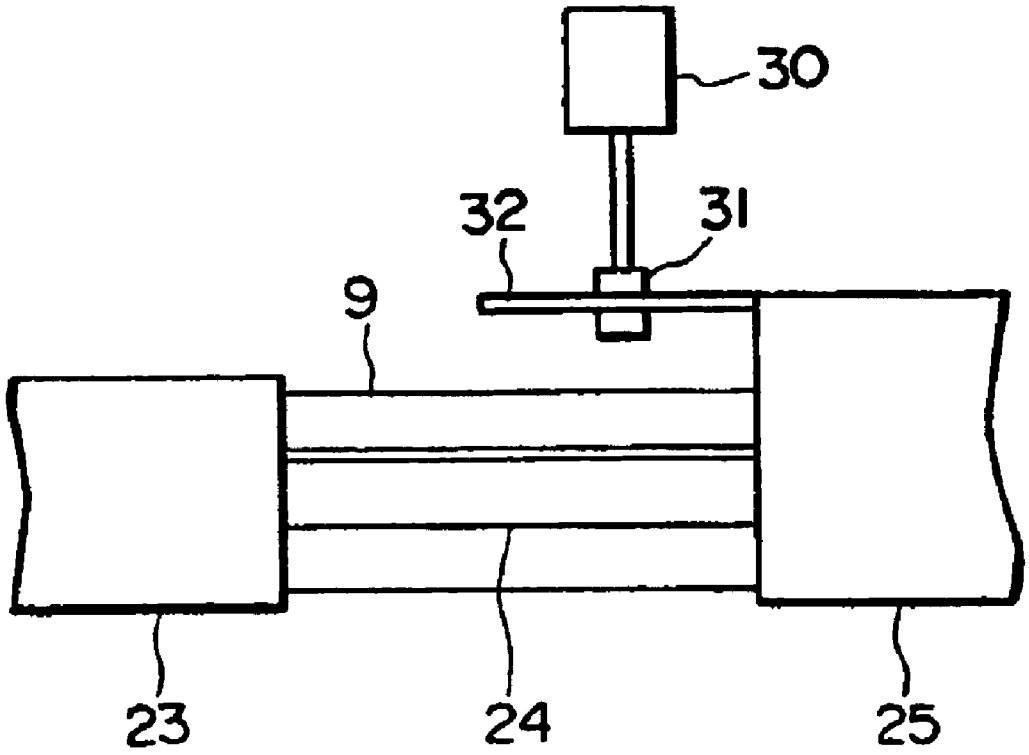
FIG. 2 is an enlarged fragmentary plan view of a portion of the rolling apparatus shown in FIG. 1.

As shown in FIG. 2, an encoder 30 is disposed on a mount 29 placed on the base 6 behind the rail 9. A rotor 31 rotatably supported on the encoder 30 is held in rolling engagement with an arm 32 which extends parallel to the piston rod 24 and is attached to a rear end of the tubular member 25. The encoder 30 has a detector (not shown) for detecting angular displacement of the rotor 31. The detector converts a detected amount of angular displacement of the rotor 31 into an amount of linear displacement of the arm 32, thus detecting an amount of linear displacement of the tension roller 2*b*.

Operation of the rolling apparatus 1 shown in FIGS. 1 and 2 will be described below.

The metal ring W is used as an element of a laminated ring for use in a belt for a continuously variable transmission. The metal ring W is prepared by welding opposite ends of a thin sheet of maraging steel, which is an ultrahigh strength steel, into a cylindrical drum, and slicing the cylindrical drum into an annular strip having a given width. The cylindrical drum is subjected to a solution treatment in order to remove welding strains.

In the rolling apparatus 1, the metal ring W is trained around the tension rollers 2*a*, 2*b* from the open front side of the casing 7. Then, the first tension cylinder 20 is actuated to displace the slide member 22 connected to the piston rod 21 along the rail 9 in a direction to displace the tension roller 2*b* away from the tension roller 2*a*. The tension roller 2*a* is not moved as it is rotatably supported on the casing 7, and hence only the tension roller 2*b* is displaced.

The second tension cylinder 23 is mounted on the slide member 22. Therefore, when the slide member 22 is displaced by the first tension cylinder 20 as described above, the second tension cylinder 23 is also displaced. As a result, the tension roller 2*b* is displaced away from the tension roller 2*a* through the piston rod f24 of the second tension cylinder 23, the tubular member 25, the slide member 10, and the support member 8, thus applying a tension to the metal ring W trained around the tension rollers 2*a*, 2*b*. The first tension cylinder 20 is inactivated when the second tension cylinder 23 reaches a position to start rolling the metal ring W. The position to start rolling the metal ring W is a position where the metal ring W trained around the tension rollers 2*a*, 2*b* is kept taut under the applied tension.

Then, the rolling cylinder 14 is actuated to lower the piston rod 15 against the bias of the spring 18. The piston rod 15 is guided by the flange 13 to press the support member 12 downwardly. The rolling roller 5 rotatably supported on the support member 12 is lowered and pressed against the metal ring W. The non-illustrated motor is energized to rotate the rolling roller 5 to start rolling the metal ring W which is gripped between the rolling roller 5 and the guide roller 4 supported by the backup roller 3. At this time, the spring 18 is compressed between the upper end of the rolling cylinder 14 and the engagement member 7.

When the metal ring W starts being rolled, its circumferential length is progressively increased. At this time, the first tension cylinder 20 is inactivated, and the second tension cylinder 23 is actuated. As a result, at the same time that the rolling cylinder 14 is actuated, the tension roller 2*b* is displaced away from the tension roller 2*a*. The displacement of the tension roller 2*b* applies a tension commensurate with the increase in the circumferential length of the metal ring W to the metal ring W, thus keeping the metal ring W taut.

Figure 3:
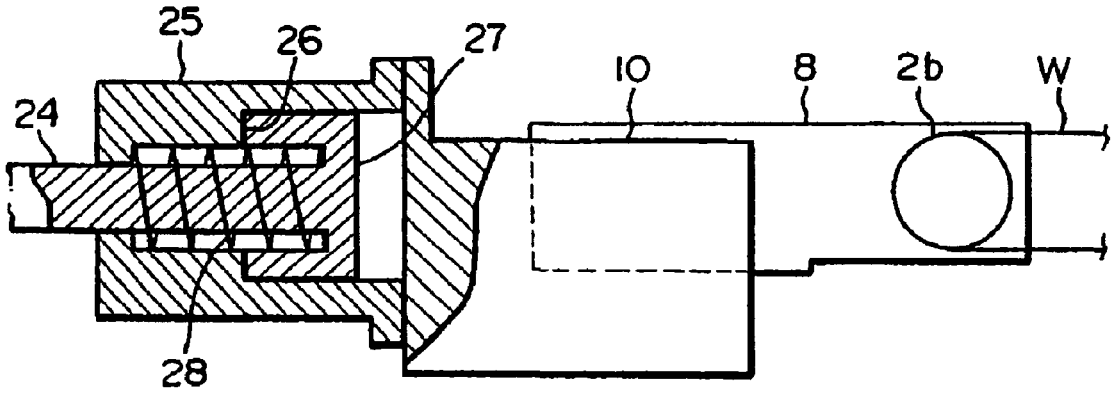
FIG. 3 is an enlarged cross-sectional view illustrative of the manner in which the rolling apparatus shown in FIG. 1 operates.

At this time, as shown in FIG. 3, the engagement member 27 mounted on the distal end of the piston rod 24 engages the step 26 in the tubular member 25 against the bias of the spring 28. The piston rod 24 now displaces the tubular member 25 in a direction away from the tension roller 2*a*. The slide member 10 on which the tubular member 25 is mounted is displaced along the rail 9 in the same direction.

As a result, the tension roller 2*b* rotatably supported on the support member 8 is displaced away from the tension roller 2*a* by the slide member 10, thereby rolling the metal ring W while keeping the metal ring W taut. At this time, the spring 28 is compressed between the closed end of the tubular member 25 closer to the second tension cylinder 23 and the engagement member 27.

As the rolling process progresses, the amount of displacement of the tension roller 2*b* is detected by the encoder 20 shown in FIG. 2. When the tension roller 2*b* is displaced as described above, the arm 32 extending from the tubular member 25 parallel to the piston rod 24 is also displaced in the same direction as the tension roller 2*b*. The encoder 30 converts the amount of angular displacement of the rotor 31 which rolls in contact with the arm 32 into an amount of linear displacement of the arm 32, and detects the amount of linear displacement of the arm 32 as an amount of linear displacement of the tension roller 2*b*. When the encoder 30 detects that the amount of linear displacement of the tension roller 2*b* has reached a predetermined amount, the encoder 30 determines that the circumferential length of the metal ring W has reached a predetermined length. As a result, the encoder 30 outputs an electric signal representing the completion of the rolling process, and the rolling cylinder 14 and the second tension cylinder 23 are stopped in response to the electric signal.

In response to the electric signal, the rolling cylinder 14 stops supplying the oil pressure into the upper chamber 14*a*. At the same time, the rolling cylinder 14 starts supplying the oil pressure into the lower chamber 14*b*, causing the piston 16 to elevate the piston rod 15 thereby to release the rolling roller 5 from pressing the metal ring W.

The rolling cylinder 14 takes a time ranging from 0.01 to 0.1 second in releasing the rolling roller 5 from pressing the metal ring W because of the above mechanical arrangement used to release the rolling roller 5. During this time, the rolling roller 5 remains pressed against the metal ring W, and continuously rotates due to the inertia from the rolling process. As a result, the metal ring W tends to be excessively rolled after the rolling process is completed.

With the rolling apparatus 1 according to the present invention, however, when the rolling cylinder 14 is stopped after the rolling process is completed, the spring 18 tends to return immediately to its original free state from the compressed state. The biasing force of the spring 18 acts on the piston rod 15 through the engagement member 17, as indicated by the arrow in FIG. 1. As a consequence, the piston rod 15 is moved upwardly as indicated by the imaginary lines in FIG. 1, releasing the rolling roller 15 from pressing the metal ring W.

As described above, when the rolling cylinder 14 is stopped after the completion of the rolling process, the spring 18 acts to immediately release the rolling roller 15 from pressing the metal ring W. The action of the spring 18 begins immediately, and does not wait for the operation of the mechanism arrangement of the rolling cylinder 14. Thus, the metal ring W is reliably prevented from being excessively rolled, and is rolled accurately to a desired circumferential length.

Since the rolling cylinder 14 and the second tension cylinder 23 are separate mechanical arrangements, they tend to stop at different times, which are 0.01 to 0.1 second apart from each other, in response to the electric signal from the encoder 30. If the stoppage of the rolling cylinder 14 is delayed from the stoppage of the second tension cylinder 23, then the metal ring W is further excessively rolled after the completion of the rolling process. Even if the rolling cylinder 14 is stopped prior to the second tension cylinder 23, the metal ring W tends to be excessively rolled after the completion of the rolling process because of continued rotation of the rolling roller 5 due to inertia from the rolling process. As a result, the metal ring W may possibly be loosened around the tension rollers 2*a*, 2*b*.

Figure 4:
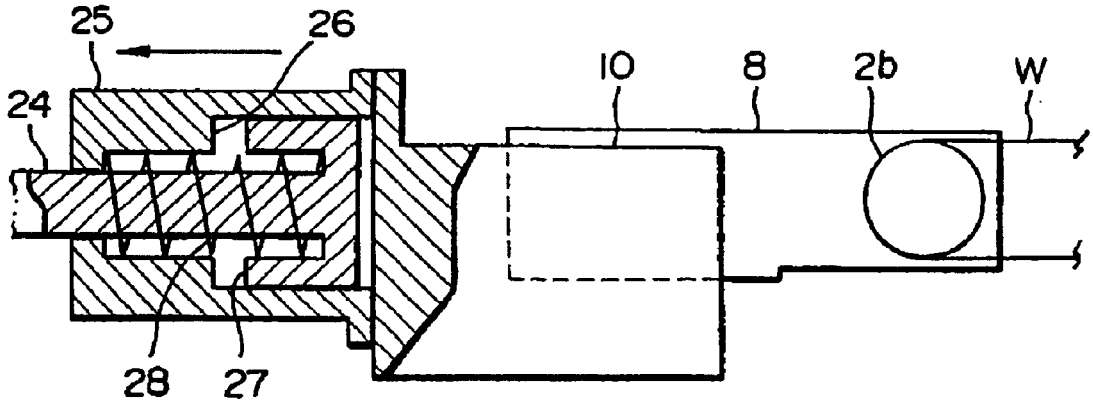
FIG. 4 is an enlarged cross-sectional view illustrative of the manner in which the rolling apparatus shown in FIG. 1 operates.

With the rolling apparatus 1 according to the present invention, however, when the second tension cylinder 23 is stopped, the spring 28 tends to return immediately to its original free state from the compressed state. The biasing force of the spring 28 acts on the tubular member 25, as indicated by the arrow in FIG. 4. As a consequence, if the metal ring W is further excessively rolled after the completion of the rolling process, the tubular member 25 is displaced from the stopped position of the piston rod 24 in a direction away from the tension roller 2*a*. The displacement of the tubular member 25 tensions the metal ring W to keep the metal ring W taut around the tension rollers 2*a*, 2*b*.

Accordingly, even when the metal ring W is loosened by being excessively rolled as described above, the metal ring W is reliably prevented from dropping off the tension rollers 2*a*, 2*b*.

In the illustrated embodiment, the spring 18 is disposed between the upper end of the rolling cylinder 14 and the engagement member 17. The spring 18 may be disposed in the rolling cylinder 14, e.g., between the lower end of the lower chamber 14*b* and the piston 16. However, the spring 18 positioned outside of the rolling cylinder 14 as shown can more easily be inspected and serviced for maintenance.

In the illustrated embodiment, the piston rod 25 of the second tension cylinder 23 is connected to the slide member 10 through the tubular member 25, and the spring 28 is disposed between the piston rod 24 and the tubular member 25. However, the spring 28 may be dispensed with in order to roll the metal ring W accurately to a desired circumferential length. If the spring 28 is dispensed with, then the piston rod 25 is directly connected to the slide member 10.

In the illustrated embodiment, the springs 18, 28 are used as resilient members. However, the springs 18, 28 may be replaced with elastomeric members made of natural rubber or synthetic rubber such as urethane resin or the like.

Industrial Applicability

The rolling apparatus according to the present invention can effectively be used as an apparatus for rolling a metal ring for use in a belt for a continuously variable transmission.

What is claimed is:

1. An apparatus for rolling a metal ring, comprising:

metal ring supporting means having a pair of tension rollers for supporting a thin-sheet metal ring thereon and a tension roller support member on which at least one of said tension rollers is rotatably supported;

rolling means having a guide roller disposed intermediate between said tension rollers, a rolling roller for gripping and rolling the metal ring between the rolling roller and said guide roller, a rolling roller support member on which said rolling roller is rotatably supported, and a rolling cylinder having a piston rod connected to said rolling roller support member for pressing said rolling roller against said metal ring through said rolling roller support member;

tension applying means having a tension cylinder having a piston rod engaging said tension roller support member for applying a tension to said metal ring by displacing said least one of said tension rollers through said tension roller support member to displace said tension rollers relatively from each other when said metal ring is rolled by said rolling means; and rolling process completing means for detecting a completion of rolling of said metal ring by measuring an amount of relative displacement of said tension rollers, and inactivating said rolling means and said tension applying means;

said rolling means having a first resilient member interposed between said rolling cylinder and said piston rod thereof, for moving said piston rod in a direction to release said rolling roller from pressing said metal ring when said rolling process completing means detects a completion of rolling of said metal ring and inactivates said rolling means.

2. An apparatus according to claim 1, wherein said first resilient member comprises a spring or a rubber member.

3. An apparatus according to claim 1, wherein said tension applying means comprises a second resilient member interposed between said tension roller support member and the piston rod of said tension cylinder, for causing said tension roller support member to displace said least one of said tension rollers away from the other tension roller to apply a tension to said metal ring when said rolling process completing means detects a completion of rolling of said metal ring and inactivates said tension cylinder.

4. An apparatus according to claim 3, wherein said second resilient member comprises a spring or a rubber member.

5. An apparatus according to claim 1, wherein said rolling process completing means comprises an arm extending from said tension roller support member parallel to the piston rod of said tension cylinder, a rotor rotatable in rolling contact with said arm, and a detector for detecting an amount of angular displacement of said rotor, and converting the amount of angular displacement of said rotor into an amount of displacement of said arm to detect an amount of displacement of said tension roller.

* * * * *